US006790164B1

(12) United States Patent
Davis

(10) Patent No.: US 6,790,164 B1
(45) **Date of Patent: *Sep. 14, 2004**

(54) SWIMMING SIMULATION SYSTEM

(76) Inventor: James Davis, 914 Wynne Wood Rd., Apt. 2H, Pelham Manor, NY (US) 10803

( * ) Notice: Subject to any disclaimer, the term of this patent is extended or adjusted under 35 U.S.C. 154(b) by 253 days.

This patent is subject to a terminal disclaimer.

(21) Appl. No.: 10/029,550

(22) Filed: Dec. 20, 2001

Related U.S. Application Data

(63) Continuation-in-part of application No. 09/650,085, filed on Aug. 29, 2000.

(51) Int. Cl.[7] ..... A63B 69/10
(52) U.S. Cl. ..... 482/56; 434/254
(58) Field of Search ..... 482/55–56, 148, 482/51, 63, 111, 112; 434/254

(56) References Cited

U.S. PATENT DOCUMENTS

| | | | | | |
|---|---|---|---|---|---|
| 1,620,146 | A | * | 3/1927 | Walton | 482/56 |
| 2,013,520 | A | * | 9/1935 | McDermott | 482/56 |
| 2,019,224 | A | * | 10/1935 | Hess | 482/56 |
| 3,791,646 | A | * | 2/1974 | Marchignoni | 482/56 |
| 6,352,493 | B1 | * | 3/2002 | Davis | 482/56 |

* cited by examiner

*Primary Examiner*—Stephen R. Crow
(74) *Attorney, Agent, or Firm*—Edward P. Dutkiewicz

(57) ABSTRACT

An athletic training system has a user support with a vertical plane extending centrally there through. A pair of similarly configured looped tracks, one track on each side of the vertical plane, each have a common cross sectional configuration throughout and an axial shape corresponding to the intended movement of the hands of a user. A handle is slidably received on each track. Each handle includes a slider and a gripping portion. A user pushes and pulls the handle in a configuration corresponding to the configuration of the track.

4 Claims, 10 Drawing Sheets

FIG 2
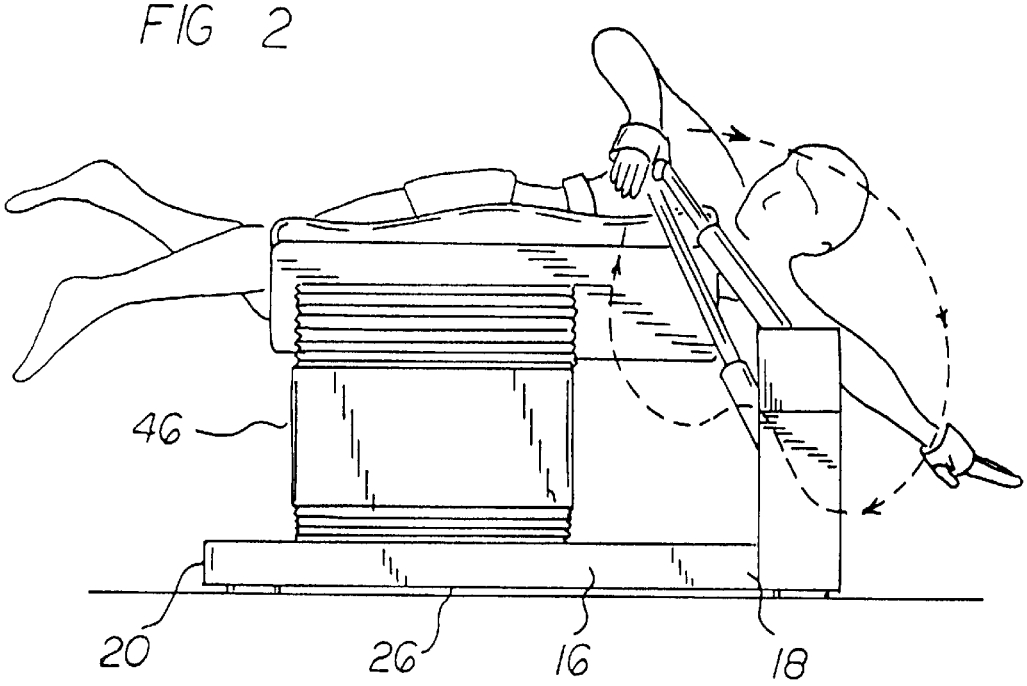
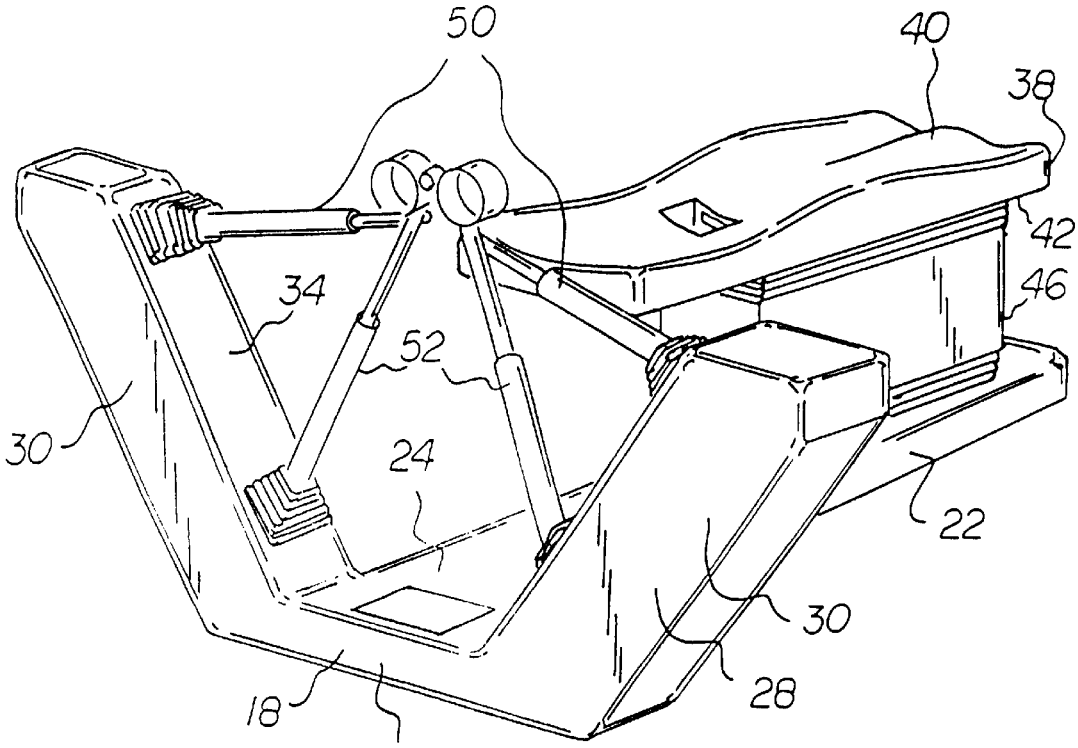
FIG 3

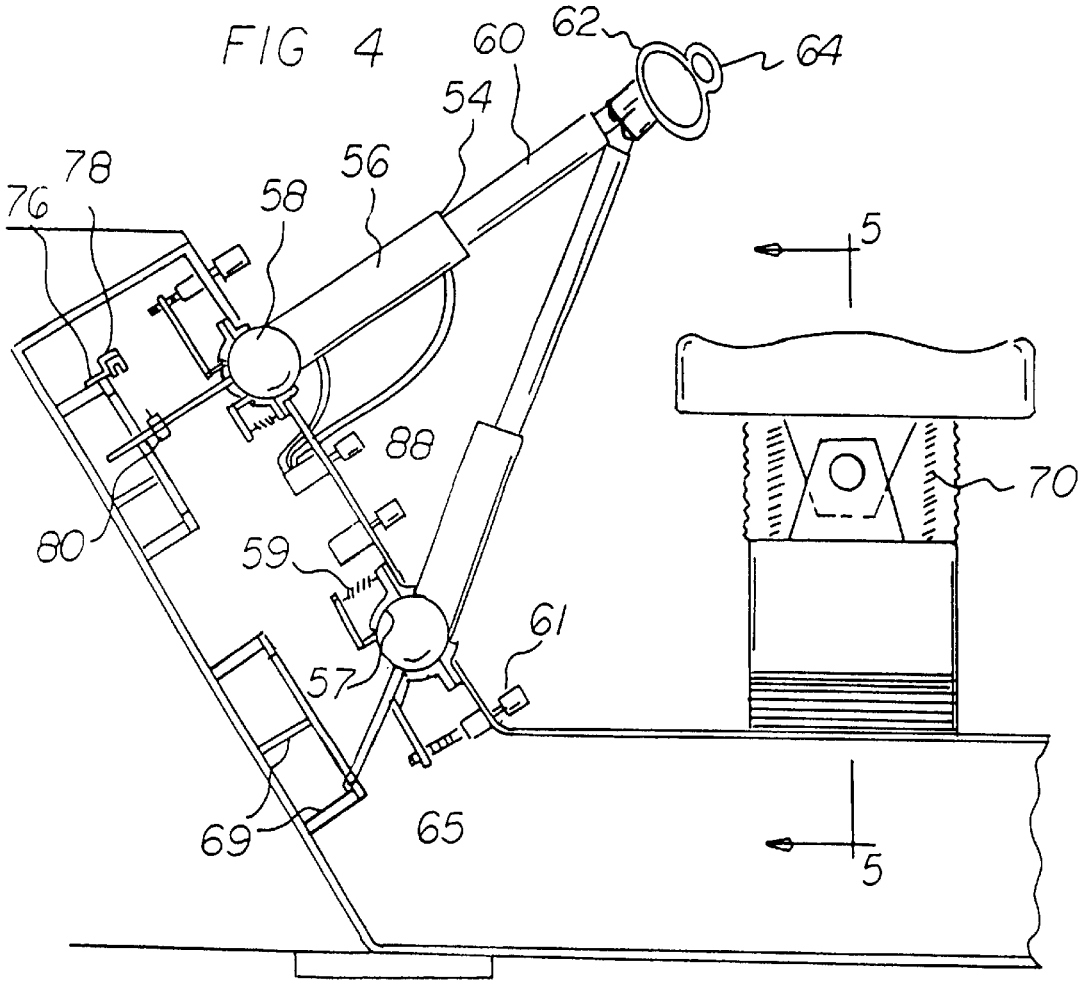
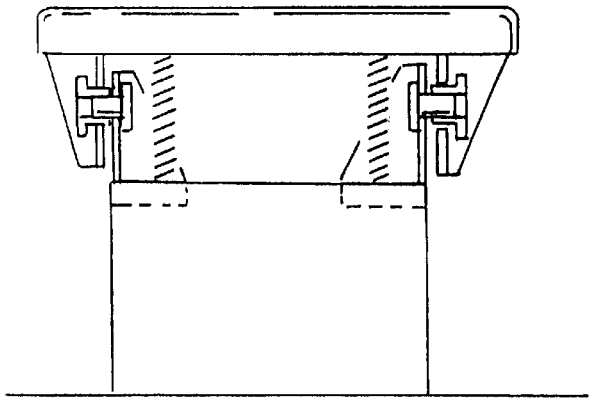
FIG 5

FIG 7A
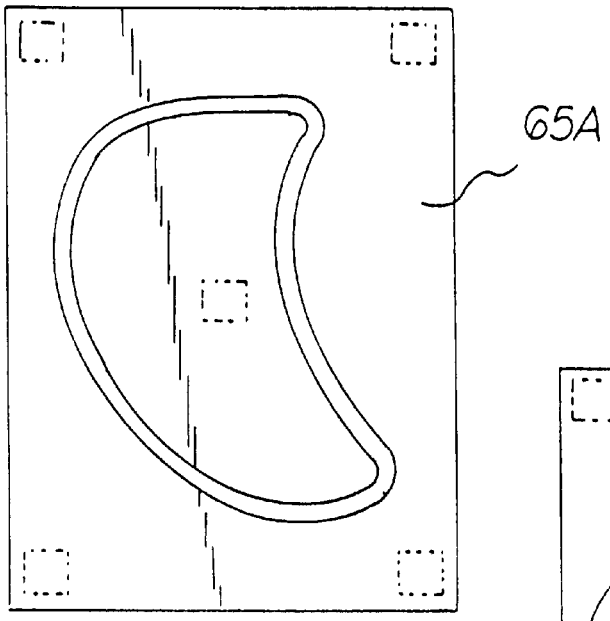
FIG 7B
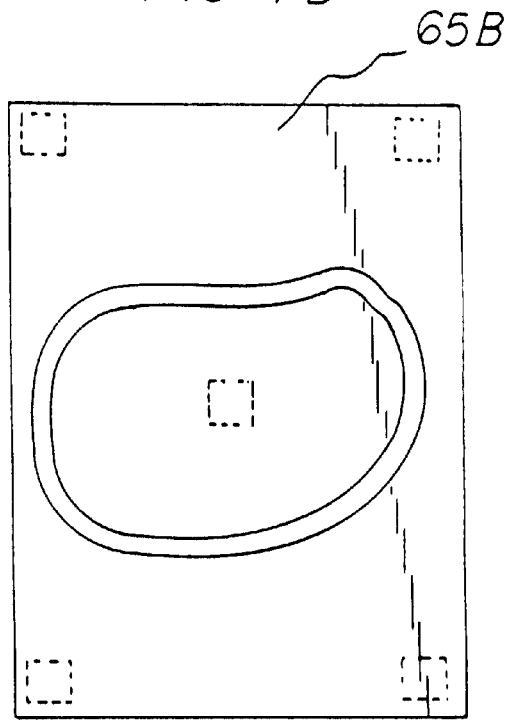
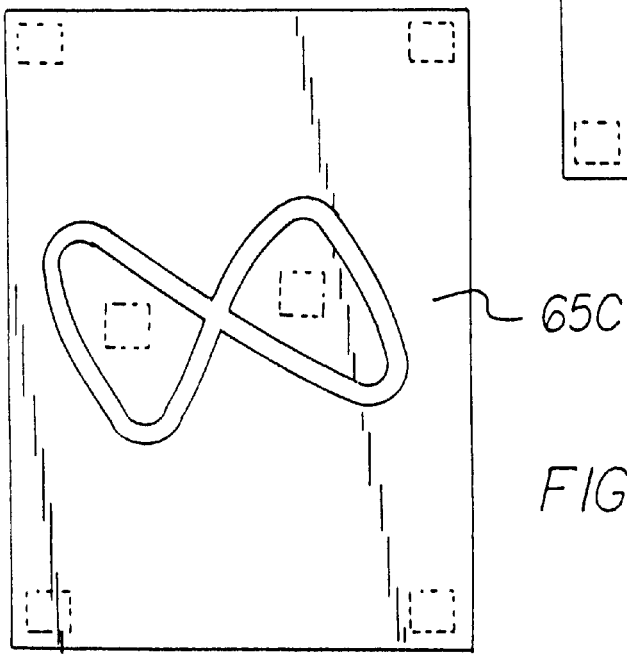
FIG 7C

FIG 8
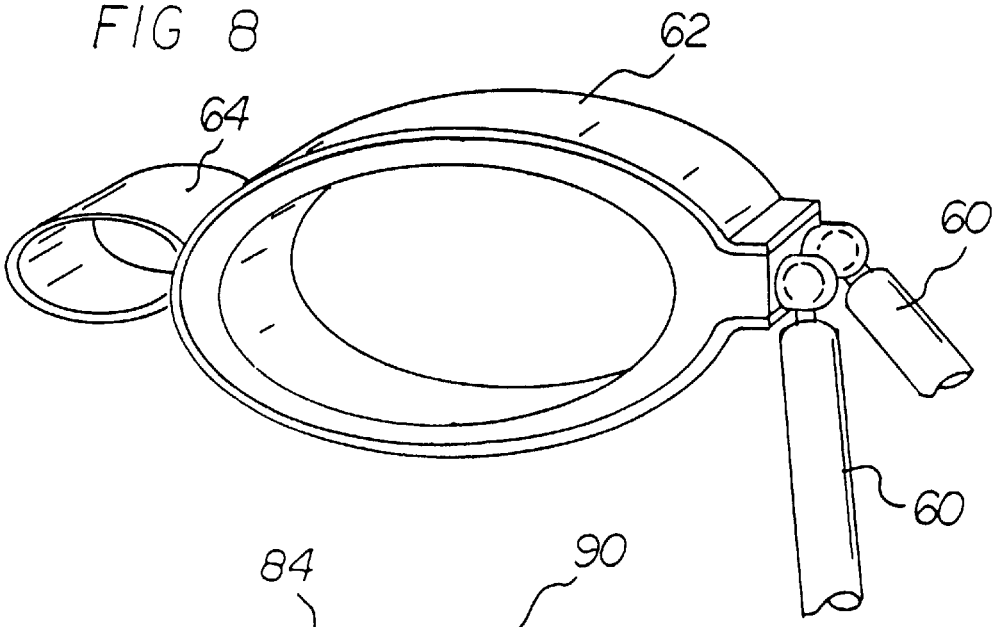
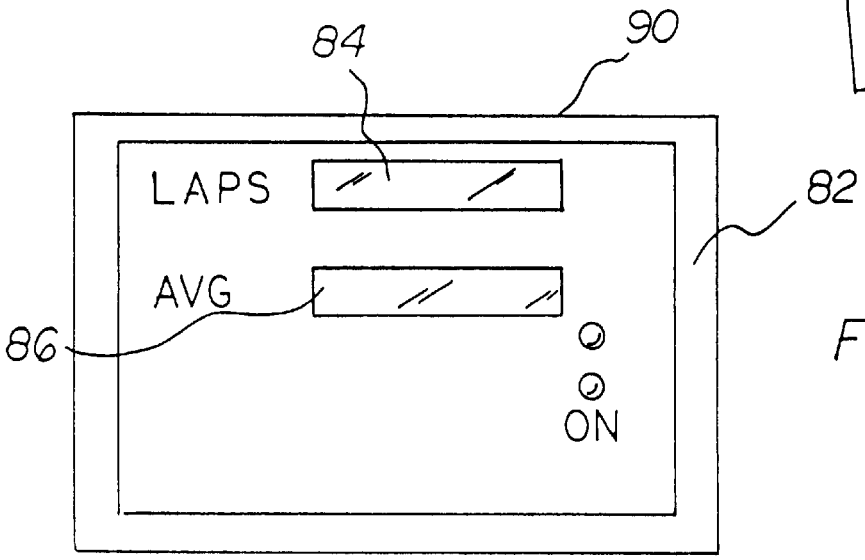
FIG 9
FIG 10
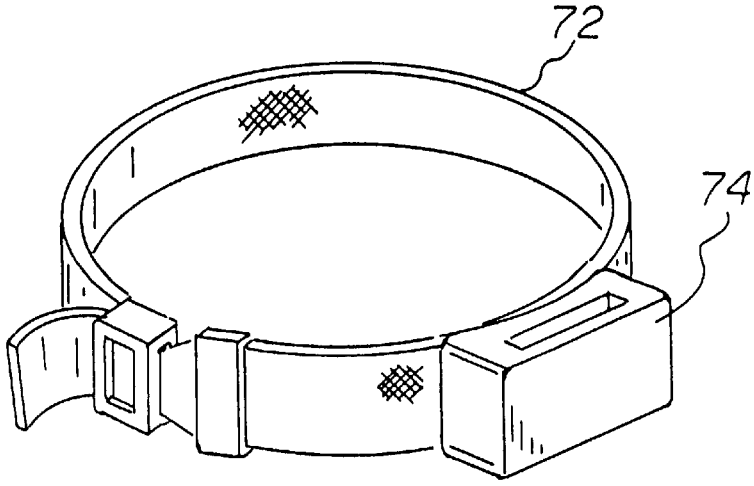

FIG 11
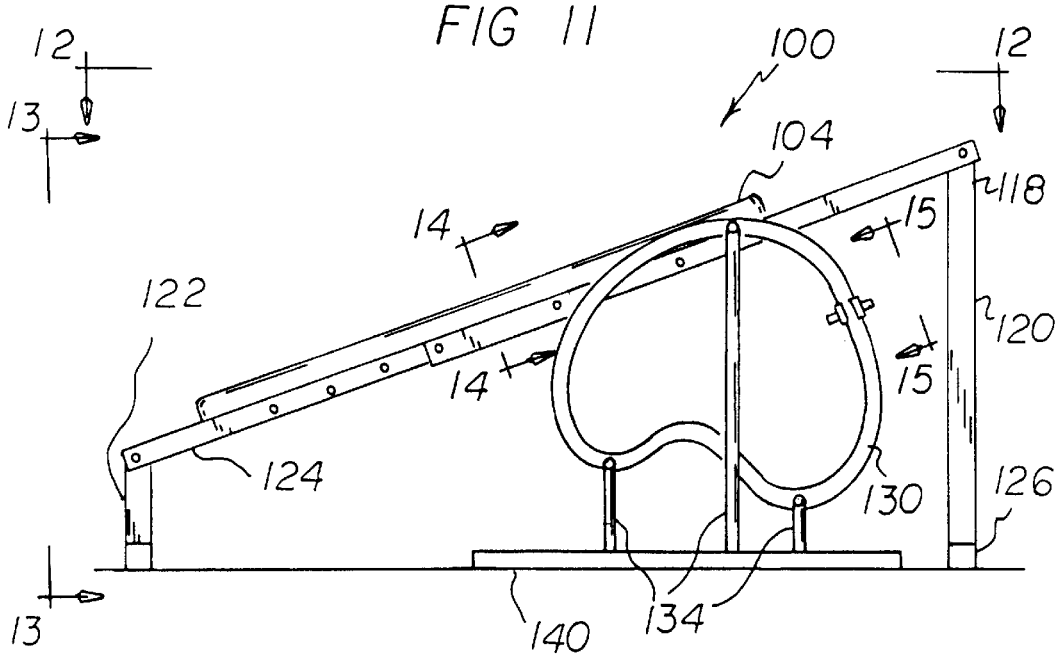
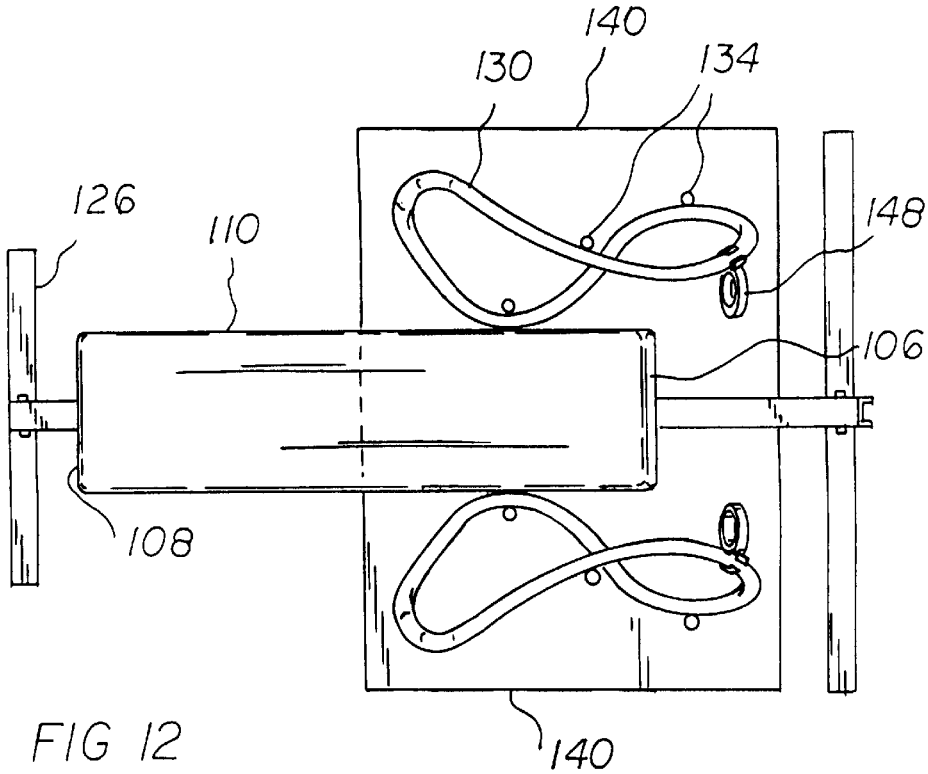
FIG 12

FIG 13
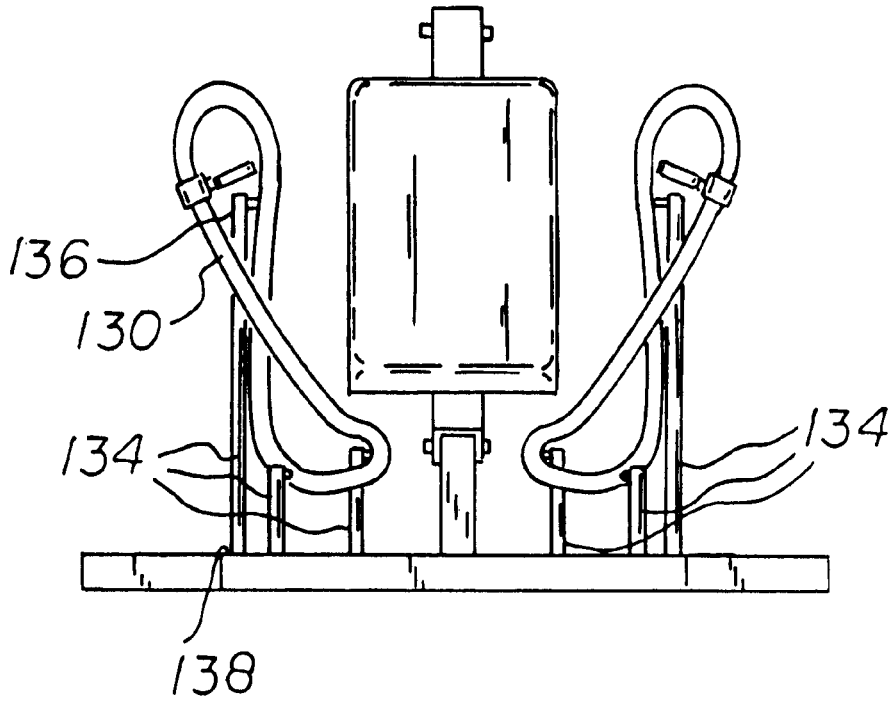
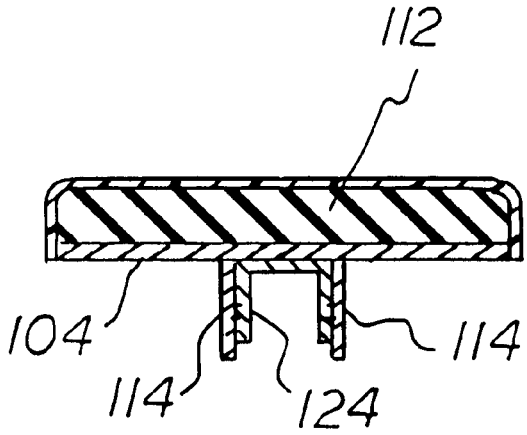
FIG 14

FIG 15
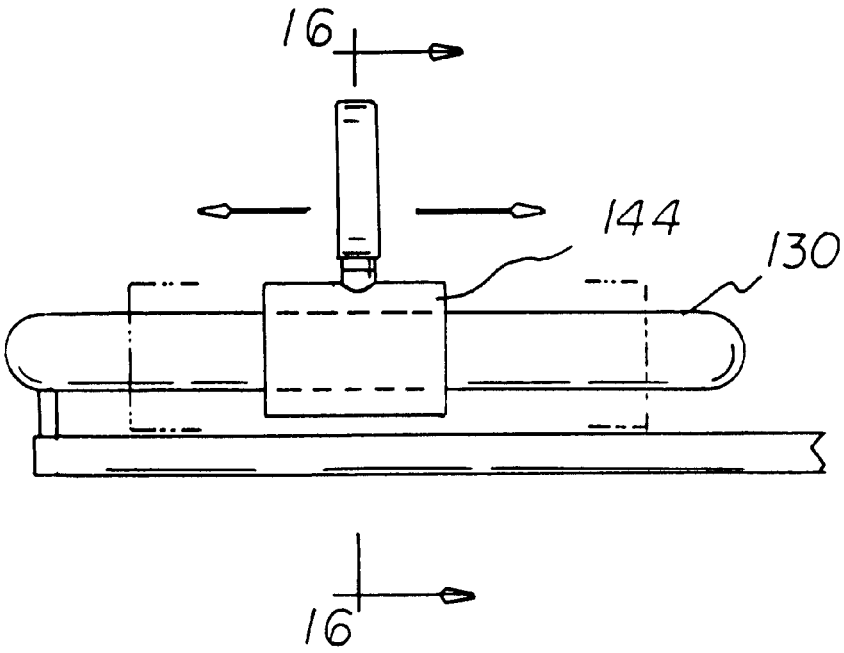
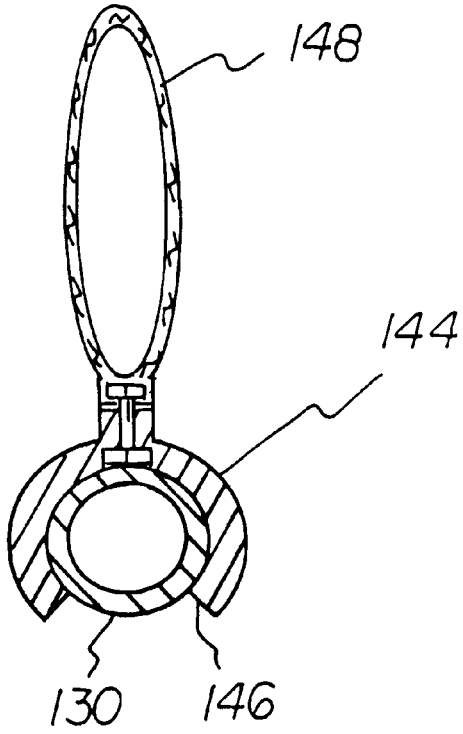
FIG 16

FIG 17
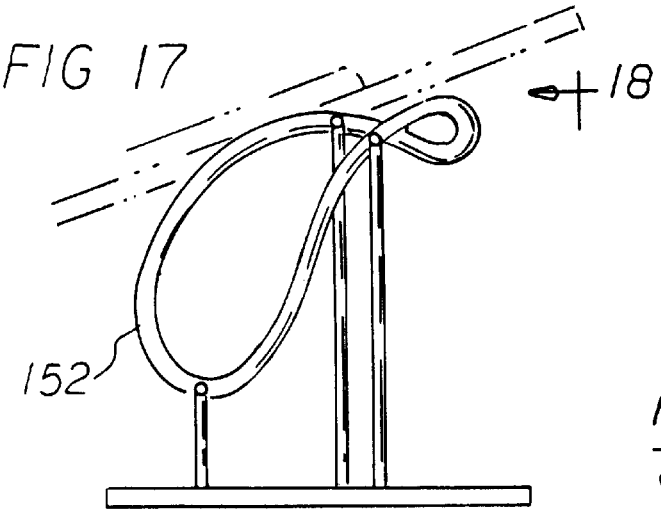
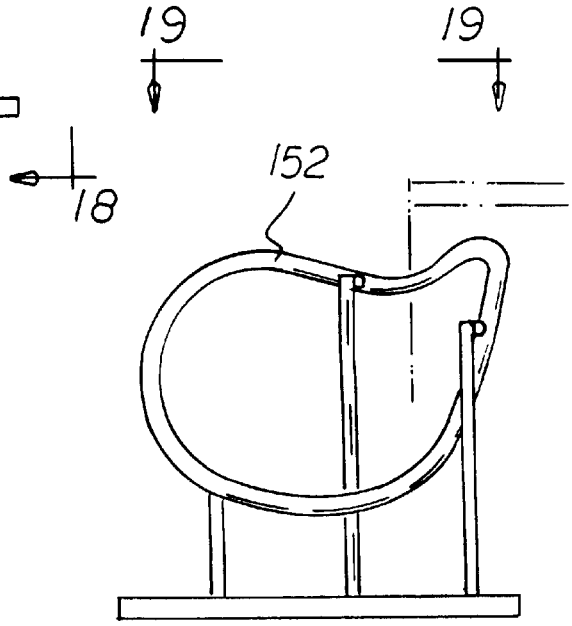
FIG 18
FIG 19
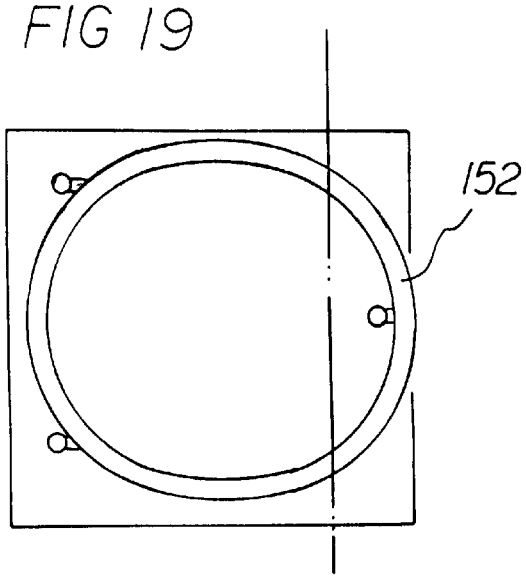

SWIMMING SIMULATION SYSTEM

RELATED APPLICATION

This patent application is a continuation-in-part patent application of co-pending application Ser. No. 09/650,085 filed Aug. 29, 2000.

BACKGROUND OF THE INVENTION

1. Field of the Invention

The present invention relates to a swimming simulation system and more particularly pertains to allowing swimmers to exercise and train out of the water and provides a sculling action to build muscle memory and strengthen those muscles used to scull versus the straight back and forth motion described in Prior Art.

2. Description of the Prior Art

The use of swimming aids of known designs and configurations is known in the prior art. More specifically, swimming aids of known designs and configurations previously devised and utilized for the purpose of permitting athletes such as swimmers to exercise and train are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,707,320 to Huei-Nan Yu discloses a swimming exerciser. U.S. Pat. No. 5,603,676 to Kenneth J. Cymbalisty discloses a crawl swim exerciser. U.S. Pat. No. 5,518,472 to Paul Chen discloses a swimming exerciser. U.S. Pat. No. 5,429,564 to Michael P. Doane discloses an exercising apparatus. U.S. Pat. No. 4,830,363 to Robert J. Kennedy discloses a dry land swimming training apparatus. U.S. Pat. No. 4,674,740 to John F. Iams and Robson L. Splane, Jr. discloses a exercise machine for simulating swimming motions. U.S. Pat. No. 5,376,060 to John J. Murray discloses a swimming simulator. U.S. Pat. No. 4,422,634 to Harry C. Hopkins discloses a swimming simulator. U.S. Pat. No. 5,282,748 to Oscar L. Little discloses a swimming simulator. U.S. Pat. No. 6,142,912 to John Profaci discloses a swim training apparatus. Lastly, U.S. Pat. No. 3,074,716 to Carl E. Mitchel and George F. Mitchel discloses a swimming instructing machine and exerciser.

While these devices fulfill their respective, particular objectives and requirements, the aforementioned patents do not describe swimming simulation system that allows muscles to be trained properly and to build the required muscle memory through the sculling action of a side to side and up and down motion.

The prior art does present solutions for out of water swimming exercise but prior art does not offer solution for the sculling action, side to side motion and up and down motion of the actual swim strokes. The present invention offers interchangeable, 4 stroke patterns, not just the Australian Crawl-like strokes.

In this respect, the swimming simulation system according to the present invention substantially departs from the conventional concepts and designs of the prior art, and in doing so provides an apparatus primarily developed for the purpose of allowing swimmers to exercise and train out of the water with muscle memory and sculling action.

Therefore, it can be appreciated that there exists a continuing need for a swimming simulation system which can be used for allowing swimmers to exercise and train properly out of the water. In this regard, the present invention substantially fulfills this need.

SUMMARY OF THE INVENTION

In view of the foregoing disadvantages inherent in the known types of swimming aids of known designs and configurations now present in the prior art, the present invention provides an improved swimming simulation system. As such, the general purpose of the present invention, which will be described subsequently in greater detail, is to provide a swimming simulation system and method which has all the advantages of the prior art and none of the disadvantages.

To attain this, the present invention essentially comprises a swimming simulation system. First provided is a swimmer support which includes an elongated rigid central section in a rectangular configuration with a short front edge and with a short parallel rear edge and with long parallel side edges there between in a generally planar configuration. Padding is on the upper surface for supporting a user. Spaced plates depend downwardly therefrom. An adjustable frame is located beneath the user support and includes a long vertical front rail with a top and a bottom and a short vertical rear rail with a top and a bottom and an angled intermediate rail coupling the tops of the front and rear rails. Transverse support rails couple the bottoms of the front and rear rails. The support and frame have a vertical plane extending centrally there through with lateral sides and a forward end and a rearward end. The support is slidably received upon the frame with the spaced plates spanning the intermediate rail. A pair of similarly configured tracks are provided in a closed loop configuration, one track on each side of the vertical plane. The tracks each have an oval cross sectional configuration and an axial shape corresponding to the movement of the hands of a swimmer doing a predetermined stroke. A plurality of vertical rods, each with an upper end and a lower end are next provided with each upper end being secured to a track at spaced points. A base plate is coupled to the lower ends for properly positioning the track with respect to the support. Lastly, a handle is slidably received on each track with each handle including a C-shaped slider with a slot having a width to allow passage of the handle across the rods. Each handle also has a gripping portion for being held and moved by a user whereby a swimmer may push and pull the handle in a closed loop configuration corresponding to the configuration of the track and thereby simulate a predetermined swimming stroke.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a swimming simulation system which has all of the advantages of the prior art swimming aids of known designs and configurations and none of the disadvantages.

It is another object of the present invention to provide a swimming simulation system which may be easily and efficiently manufactured and marketed.

It is further object of the present invention to provide a swimming simulation system which is of durable and reliable constructions.

An even further object of the present invention is to provide a swimming simulation system which is susceptible of a low cost of manufacture with regard to both materials and labor, and which accordingly is then susceptible of low prices of sale to the consuming public, thereby making such swimming simulation system economically available to the buying public.

Even still another object of the present invention is to provide a swimming simulation system for allowing swimmers to exercise and train out of the water.

Lastly, it is an object. of the present invention to provide an athletic training system comprising a user support for a person using the system having a vertical plane extending centrally there through; a pair of similarly configured looped tracks, one track on each side of the vertical plane, the tracks each having a common cross sectional configuration throughout and an axial shape corresponding to the intended movement of the hands of a user; and a handle slidably received on each track, each handle including a slider and a gripping portion for being held and moved by a user whereby a user may push and pull the handle in a configuration corresponding to the configuration of the track.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the system shown in FIG. 1.

FIG. 3 is a perspective illustration of the system shown in FIGS. 1 and 2 but without a swimmer on the table.

FIG. 4 is a front elevational view partly in cross section taken in the lower left portion of FIG. 1.

FIG. 5 is a cross sectional view taken along line 5.5 in FIG. 4.

FIG. 7A is a plan view of a template for the butterfly stroke.

FIG. 7B is a plan view of a template for the breast stroke.

FIG. 7C is a plan view of a template for a back stroke.

FIG. 8 is a enlarged perspective showing of the loops for the user's hand and thumb.

FIG. 9 is a front elevational view of the computer readout.

FIG. 10 is a perspective illustration of the user's belt in associated coupling mechanisms.

FIG. 11 is a side elevational view of an alternate embodiment of the invention.

FIG. 12 is a plan view of the alternate embodiment of the invention as shown in FIG. 11 taken along line 11—11 of FIG. 11.

FIG. 13 is an end elevational view of the alternate embodiment shown in FIG. 11 taken along line 12—12 of FIG. 11.

FIG. 14 is a cross sectional view taken along line 14—14 of FIG. 11.

FIG. 15 is a cross sectional view taken along line 15—15 of FIG. 11.

FIG. 16 is a cross sectional view taken along line 16—16 of FIG. 15.

FIG. 17 if a side elevational view similar to FIG. 11 but illustrating an alternate set of tracks for simulating an alternate stroke to be practiced.

FIG. 18 is a front elevational view taken along line 18—18 of FIG. 17.

FIG. 19 is a plan view taken along line 19—19 of FIG. 18.

The same reference numerals refer to the same parts throughout the various Figures.

DESCRIPTION OF THE PREFERRED EMBODIMENT

Figure 1:
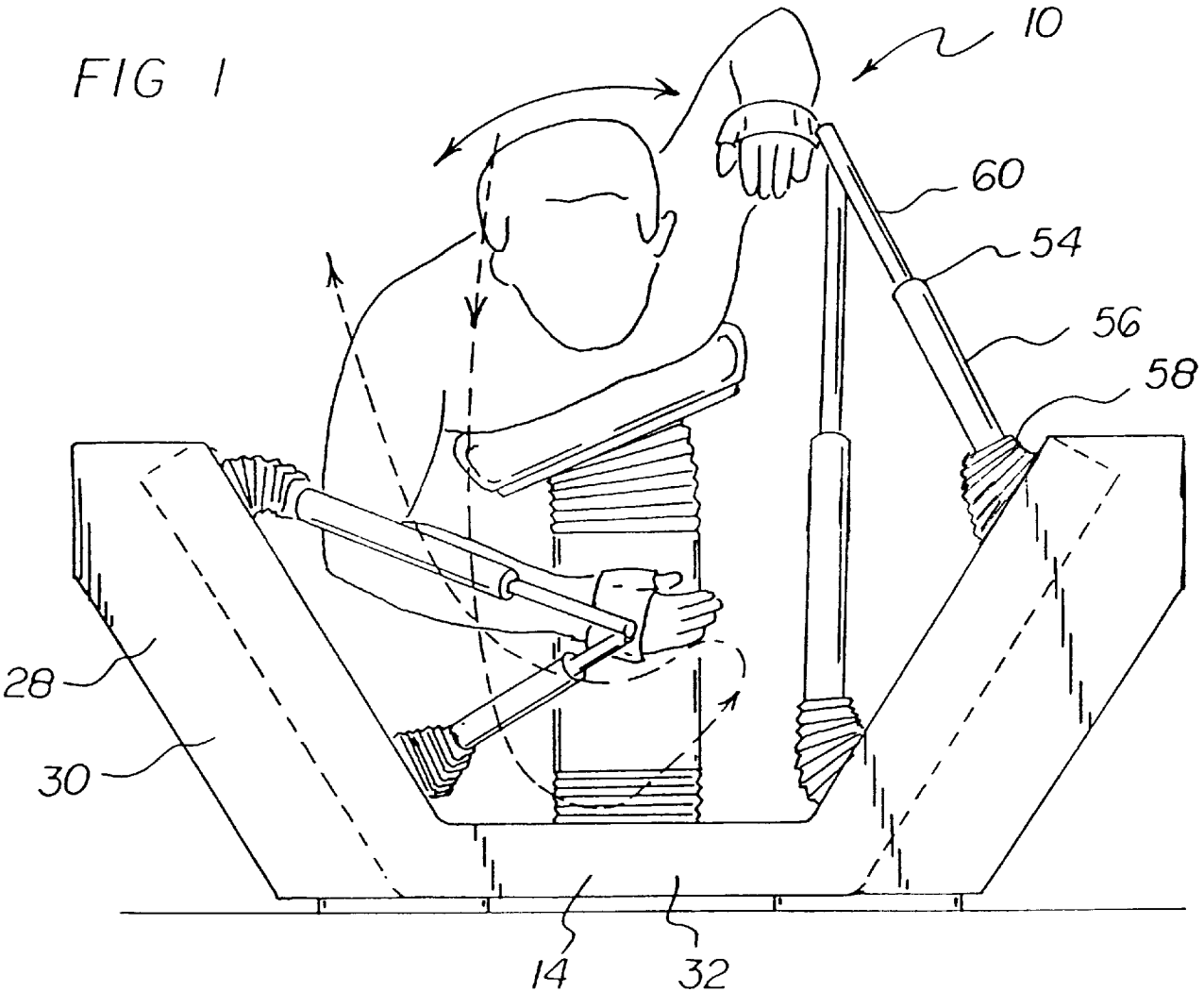
FIG. 1 is a front elevational view of the swimming simulation system constructed in accordance with principles of the present invention.
Figure 6:
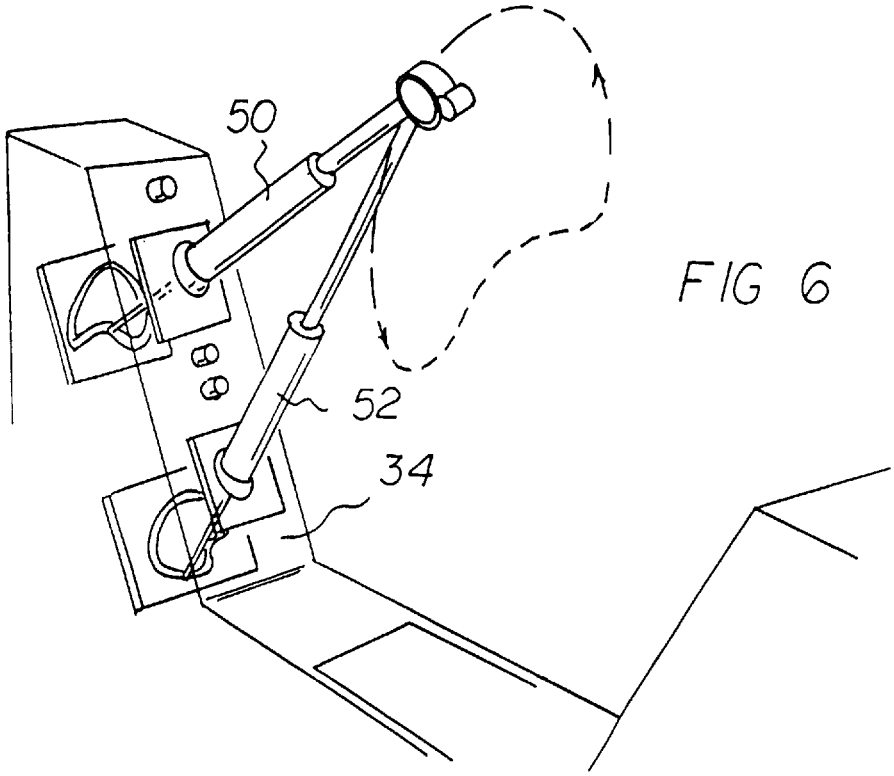
FIG. 6 is a perspective illustration of the lefthand portion of FIG. 3 with parts removed to show certain internal constructions thereof.

With reference now to the drawings, and in particular to FIGS. 1 through 10 thereof, the preferred embodiment of the swimming simulation system embodying the principles and concepts of the present invention and generally designated by the reference numeral 10 will be described.

The present invention, the swimming simulation system 10 is comprised of a plurality of components. Such components in their broadest context include a base assembly, a table, a table support block, an upper air cylinder and a lower air cylinder. Such components are individually configured and correlated with respect to each other so as to attain the desired objective.

The swimming simulation system 10 of the present invention is for allowing swimmers to exercise and train out of the water while being able to monitor their progress on a computer display.

First provided is a base assembly 14. The base assembly includes an elongated central section 16 in a rectangular configuration. The central section includes a short front edge 18 and a short parallel rear edge 20. The central section also includes long parallel side edges 22 between the front and rear edges. The base assembly has a planar upper surface 24 and a planar lower surface 26. The base assembly also includes a generally v-shaped section 28. The v-shaped section has legs 30. The legs extend upwardly from adjacent to the front edge of the central section 32. The v-shaped section has a central portion which is formed as an extension of the central section. Interior slopping faces 34 extend upwardly from the central portion at angles of about 60 degrees from the horizontal.

Next provided is a table 38 in a generally horizontal orientation. The table has an upper contoured surface 40 to comfortably receive the torso of a user. The lower surface 42 is overlying and supported above the central section at a location intermediate to the front and rear edges of the central section.

A table support block 46 is next provided. Such block is formed in a rectangular configuration. This block is secured to the upper surface of the central section. The support block is spaced rearwardly of the v-shaped section and functions to support the table.

An upper air cylinder 50 and a lower air cylinder 52 are next provided. Each air cylinder has an exterior end 54 and an interior end 56. A ball joint 58 is coupled to each associated interior sloping face for universal rotation between the cylinders and the interior sloping faces. Plates 57 support the ball joints with spring supports 59 and adjustors 61. Each air cylinder has a reciprocable rod 60 extending from within the exterior end of its associated air cylinder. Coupled to the exterior ends of the reciprocable rods on each sloping face is a hand-receiving loop 62 with an associated thumb-receiving loop 64.

Figure 7:
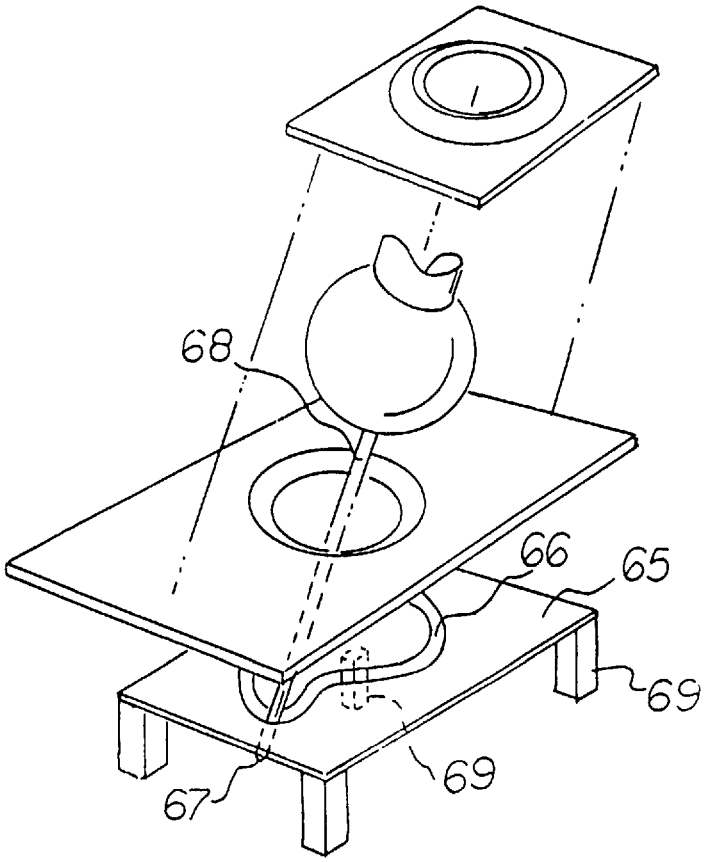
FIG. 7 is a exploded perspective view of the universal joint with a template for the freestyle stroke.

Next provided is a template 65 beneath each ball joint constituting a template set for a particular stroke and with a slot 66 through each template in a shape corresponding to the preferred arm movement of a particular swimming stroke. A finger 67 is secured to the ball joint extending downwardly through the slot of the template to ensure proper arm movements of a user. In use each system would include four template sets, each set having four templates, one for each ball joint. One set would be for each stroke: a template 65A in a kidney configuration for the butterfly stroke as shown in Figure A, a template 65B in a generally oval configuration for the breaststroke as shown in FIG. 7B, a template 65C in a FIG. 8 configuration for the backstroke as shown in FIG. 7C, and a template in a generally triangular configuration for the freestyle or crawl stroke as shown in FIG. 7. Each shown template is for one arm, but it should be understood that a corresponding template in a mirror image configuration would be provided for the other arm. Additionally, posts 69 beneath the templates provide space there beneath for the movement of the fingers 68.

Next provided is a horizontal pivot pin 68. The horizontal pivot pin couples the table and the table support block. The pivot pin functions to allow for lateral pivoting of the table with respect to the table support. Laterally positioned springs 70 are provided. The springs function to control the pivoting of the table with respect to the table support. The table also has a strap 72 with an associated clamp 74 functioning to releasably retain a user on the table during operation and use.

A control assembly 76 is next provided. The control assembly includes a Hall effect magnetic sensor 78, 80 operatively coupled with respect to each finger and a fixed portion of the housing to respond as a result of the movement of the ball joints individually. A display panel 82 is provided on the upper surface of the base assembly. It is preferably located between the legs of the v-shaped section within view of a user. The display panel allows a user to display duration as "laps" 84 and speed as "average" 86 as a function of the rate of triggering of sensors 88 following the motion of the air cylinders 50 when the user moves through a full range of motion.

Lastly, a computer system 90 is provided. The computer system functions to read the output from the sensors 88 to effect a proper display.

An alternate embodiment of the invention is shown in FIGS. 11 through 19. Such system is an athletic training system 100 for allowing swimmers to exercise a wide variety of muscles while simulating any of a plurality of strokes. More broadly it allows any athlete to exercise his or her muscles. Such invention includes, as a first component, a swimmer support 102. Such support includes an elongated rigid central section 104 in a rectangular configuration with a short front edge 106 and with a short parallel rear edge 108 and with long parallel side edges 110 there between. Such support is in a generally planar configuration with padding 112 on the upper surface for supporting a user and also includes spaced plates 114 depending downwardly from the under side.

Next provided is an adjustable frame 118 beneath the user support. Such frame includes a long vertical front rail 120 with a top and a bottom and a short vertical rear rail 122 with a top and a bottom. The frame includes an angled intermediate rail 124 coupling the tops of the front and rear rails. Transverse support rails 126 couple the bottoms of the front and rear rails. The support and frame having a vertical plane extending centrally there through with lateral sides and a forward end and a rearward end. The support is slidably received upon the frame with the spaced plates spanning the intermediate rail to allow for sliding of the support on the intermediate rail during operation and use.

A pair of similarly configured tracks 130 in a closed loop configuration are next provided. One track is on each side of the vertical plane. The tracks each have an oval cross sectional configuration and an axial shape corresponding to the movement of the hands of a swimmer doing a predetermined stroke.

Next provided is a plurality of vertical rods 134. Each rod has an upper end 136 and a lower end 138. Each upper end is secured to a track at spaced points and with a base plate 140 coupled to the lower ends for properly positioning the track with respect to the support.

Lastly, a handle 144 is slidably received on each track. Each handle includes a C-shaped slider with a slot 146 having a width to allow passage of the handle across the rods. The oval cross sectional configuration of the rail and corresponding cross sectional shape of the slider precludes rotation there between for allowing passage of the slider past the vertical rods. Each handle also has a gripping portion 148 for being held and moved by a user. In this manner, a swimmer may push and pull the handle in a closed loop configuration corresponding to the configuration of the track and thereby simulate a predetermined swimming stroke. Due to the arrangement of components, the hands of the user may move forwardly and rearwardly as well as laterally from the user and vertical central plane.

The present invention has utility in allowing swimmers to exercise and train out of the water while being able to monitor their progress on a computer display. The action of the present invention includes a sculling action, side-to-side, and allows strengthening those muscles to scull. The action of the prior art is front-to-back and does not target the necessary muscle training. The prior art does not address the concept of sculling, i.e., lift drag in water. Additionally, with the use of different templates, specific muscles can be targeted. The present invention also has utility as an aid in physical therapy where the motion and exercise of the shoulders and arms is desired following injury and/or surgery.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An athletic training system for allowing swimmers to exercise a wide variety of muscles while simulating any of a plurality of strokes comprising, in combination:

a swimmer support including an elongated rigid central section in a rectangular configuration with a short front edge and with a short parallel rear edge and with long parallel side edges there between in a generally planar configuration with padding on the upper surface for supporting a user and spaced plates depending downwardly therefrom;

an adjustable frame beneath the user support including a long vertical front rail with a top and a bottom and a short vertical rear rail with a top and a bottom and an angled intermediate rail coupling the tops of the front and rear rails, transverse support rails coupling the bottoms of the front and rear rails, the support and frame having a vertical plane extending centrally there through with lateral sides and a forward end and a rearward end, the support being slidably received upon the frame with the spaced plates spanning the intermediate rail;

a pair of similarly configured tracks in a closed loop configuration, one track on each side of the vertical plane, the tracks each having an oval cross sectional configuration and an axial shape corresonding to the movement of the hands of a swimmer doing a predetermined stroke;

a plurality of vertical rods, each with an upper end and a lower end, each upper end being secured to a track at spaced points and with a base plate coupled to the lower ends for properly positioning the track with respect to the support; and a handle slidably received on each track, each handle including a C-shaped slider with a slot having a width to allow passage of the handle across the rods, each handle also having a gripping portion for being held and moved by a user whereby a swimmer may push and pull the handle in a closed loop configuration corresponding to the configuration of the track and thereby simulate a predetermined swimming stroke.

2. An athletic training system comprising:

a user support for a person using the system having a vertical plane extending centrally there through;

a pair of similarly configured looped tracks, one track on each side of the vertical plane, the tracks each having a common cross sectional configuration throughout and an axial shape corresponding to the intended movement of the hands of a user, the axial shape of the tracks and the intended movement of the hands of the user including horizontal shape and movement toward and away from the vertical plane and shape and vertical shape and movement parallel with the vertical plane; and a handle slidably received on each track, each handle including a slider and a gripping portion for being held and moved by a user whereby a user may push and pull the handle in a configuration corresponding to the configuration of the track.

3. The system as set forth in claim 2 wherein the tracks are in a closed loop configuration allowing a three dimensional stroke training.

4. The system as set forth in claim 2 and further including a plurality of interchangeable tracks for simulating a plurality of swim stokes.

* * * * *